US007984770B2

(12) United States Patent
Sehsah

(10) Patent No.: US 7,984,770 B2
(45) Date of Patent: Jul. 26, 2011

(54) METHOD FOR DETERMINING FORMATION INTEGRITY AND OPTIMUM DRILLING PARAMETERS DURING DRILLING

(75) Inventor: Ossama Ramzi Sehsah, Katy, TX (US)

(73) Assignee: At-Balance Americas, LLC, Houston, TX (US)

( * ) Notice: Subject to any disclaimer, the term of this patent is extended or adjusted under 35 U.S.C. 154(b) by 304 days.

(21) Appl. No.: 12/326,925

(22) Filed: Dec. 3, 2008

(65) Prior Publication Data

US 2010/0133007 A1 Jun. 3, 2010

(51) Int. Cl.
*E21B 21/08* (2006.01)

(52) U.S. Cl. ..... 175/48; 175/25; 175/38

(58) Field of Classification Search ..... 175/25, 175/38, 48; 73/152.21, 152.29
See application file for complete search history.

(56) References Cited

U.S. PATENT DOCUMENTS

| | | | |
|---|---|---|---|
| 6,926,801 | B2 | 8/2005 | Sweatman et al. |
| 7,044,237 | B2 | 5/2006 | Leuchtenberg |
| 7,185,719 | B2 | 3/2007 | van Riet |
| 2003/0079912 | A1 | 5/2003 | Leuchtenberg |
| 2007/0227774 | A1 | 10/2007 | Reitsma et al. |

OTHER PUBLICATIONS

International Search Report and Written Opinion, International Application No. PCT/US2009/066422.

*Primary Examiner* — Giovanna C Wright
(74) *Attorney, Agent, or Firm* — Richard A. Fagin

(57) ABSTRACT

A method for determining formation integrity during drilling of a wellbore includes determining an annulus fluid pressure in a wellbore during drilling thereof. The annulus pressure is adjusted by a predetermined amount. Flow rate of drilling fluid into the wellbore is compared to drilling fluid flow rate out of the wellbore. At least one of a formation pore pressure and a formation fracture pressure is determined from the annulus pressure when the compared flow rates differ by a selected amount. The method alternatively to determining pore and/or fracture pressure includes determining a response of the wellbore to the adjusted fluid pressure and determining the optimum annulus fluid pressure from the wellbore response.

15 Claims, 4 Drawing Sheets

METHOD FOR DETERMINING FORMATION INTEGRITY AND OPTIMUM DRILLING PARAMETERS DURING DRILLING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling wellbores through subsurface rock formations. More specifically, the invention relates to methods for determining and maintaining optimum wellbore fluid pressure during drilling and using wellbore fluid pressure response measurements to determine formation integrity and optimal drilling operating parameters.

2. Background Art

The exploration for and production of hydrocarbons from subsurface rock formations requires devices to reach and extract the hydrocarbons from the rock formations. Such devices are typically wellbores drilled from the Earth's surface to the hydrocarbon-bearing rock formations in the subsurface. The wellbores are drilled using a drilling rig. In its simplest form, a drilling rig is a device used to support a drill bit mounted on the end of a pipe known as a "drill string." A drill string is typically formed from lengths of drill pipe or similar tubular segments threadedly connected end to end. The drill string is longitudinally supported by the drilling rig structure at the surface, and may be rotated by devices associated with the drilling rig such as a top drive, or kelly/kelly busing assembly. A drilling fluid made up of a base fluid, typically water or oil, and various additives is pumped down a central opening in the drill string. The fluid exits the drill string through openings called "jets" in the body of the rotating drill bit. The drilling fluid then circulates back toward the surface in an annular space formed between the wellbore wall and the drill string, carrying the cuttings from the drill bit so as to clean the wellbore. The drilling fluid is also formulated such that the fluid pressure applied by the drilling fluid is typically greater than surrounding formation fluid pressure, thereby preventing formation fluids from entering the wellbore and collapse of the wellbore. However, such formulation also must provide that the hydrostatic pressure does not exceed the pressure at which the formations exposed by the wellbore will fail (fracture).

It is known in the art that the actual pressure exerted by the drilling fluid ("hydrodynamic pressure") is related to its formulation as explained above, its other rheological properties, such as viscosity, and the rate at which the drilling fluid is moved through the drill string into the wellbore. It is also known in the art that by suitable control over the discharge of drilling fluid from the wellbore through the annular space, it is possible to exert pressure in the annular space between the drill string and the wellbore wall that exceeds the hydrostatic and hydrodynamic pressures by a selected amount. There have been developed a number of drilling systems called "dynamic annular pressure control" (DAPC) systems that perform the foregoing fluid discharge control. One such system is disclosed, for example, in U.S. Pat. No. 6,904,981 issued to van Riet and assigned to the assignee of the present invention. The DAPC system disclosed in the '981 patent includes a fluid backpressure system in which fluid discharge from the borehole is selectively controlled to maintain a selected pressure at the bottom of the borehole, and fluid is pumped down the drilling fluid return system to maintain annulus pressure during times when the mud pumps are turned off (and no mud is pumped through the drill string). A pressure monitoring system is further provided to monitor detected borehole pressures, model expected borehole pressures for further drilling and to control the fluid backpressure system. U.S. Pat. No. 7,395,878 issued to Reitsma et al. and assigned to the assignee of the present invention describes a different form of DAPC system.

The formulation of the drilling fluid and when used, supplemental control over the fluid discharge such as by using a DAPC system, are intended to provide a selected fluid pressure in the wellbore during drilling. Such fluid pressure is, as explained above, selected so that fluid pressure from the pore spaces of certain subsurface formations does not enter the wellbore, so that the wellbore remains mechanically stable during continued drilling operations, and so that exposed rock formation are not hydraulically fractured during drilling operations. DAPC systems, in particular, provide increased ability to control the fluid pressure in the wellbore during drilling operations without the need to reformulate the drilling fluid extensively. As explained in the patents referenced above, using DAPC systems may also enable drilling wellbores through formations having fluid pressures and fracture pressures such that drilling using only formulated drilling fluid and uncontrolled fluid discharge from the wellbore is essentially impossible.

Selection of the correct wellbore fluid pressure, even when using DAPC systems, however, requires at least prior estimation of the fluid pressure and the fracture pressures of the formations being drilling. Techniques known in the art for estimating such pressures include analysis of seismic surveys and gravity surveys. Other techniques may include refining estimates made from seismic and gravity surveys using actual drilling measurements and/or fluid pressure measurements from nearby wellbores. Irrespective of the techniques used to estimate formation fluid pressures and fracture pressures, the actual fluid pressures and fracture pressures encountered during drilling the wellbore may be different from those predicted or estimated. Inaccurate estimation of the fluid pressures and the fracture pressures may result in reduced drilling efficiency, increased risk of formation fracturing, increased risk of wellbore collapse, increased risk of drilling faults such as the pipe string becoming stuck in the wellbore, and increased risk of setting protective pipe or casing at incorrect depths with regard to the actual formation fluid pressures and fracture pressures.

There is a need for techniques to estimate the formation pore fluid pressures and formation fracture pressures while drilling, in order to better define formation integrity for correct casing depth selection and in order to better select drilling operating parameters for efficient drilling.

SUMMARY OF THE INVENTION

A method for determining formation integrity during drilling of a wellbore according to one aspect of the invention includes determining an annulus fluid pressure in a wellbore during drilling thereof. The annulus pressure is adjusted by a predetermined amount. Flow rate of drilling fluid into the wellbore is compared to drilling fluid flow rate out of the wellbore. At least one of a formation pore pressure and a formation fracture pressure is determined when the compared flow rates differ by a selected amount.

A method for determining optimum drilling operating parameters during drilling of a wellbore according to another aspect of the invention include determining an annulus fluid pressure in a wellbore during drilling thereof. The annulus pressure is adjusted by a predetermined amount. At least one of a hookload, a drill string torque, a flow rate of drilling fluid into the wellbore and a rate of lengthening of the wellbore is measured. The flow rate is changed while maintaining a fluid pressure in a wellbore annulus proximate the bottom of the wellbore substantially constant. The measuring the at least one of hookload, drill string torque and rate of lengthening is repeated. Optimum values of flow rate and wellbore annulus pressure are determined using the measured hookload, drill string torque and rate of lengthening.

Other aspects and advantages of the invention will be apparent from the following description and the appended claims.

DETAILED DESCRIPTION

Methods according to the invention in general make use of a dynamic annular pressure control (DAPC) system during drilling of a wellbore to adjust the fluid pressure in a wellbore annulus to selected values during drilling, and testing the response of the wellbore to such adjustment. Testing the wellbore response may include determining whether fluid is entering or being lost from the wellbore. Testing the wellbore response may also include determining response of a drilling system to the changed pressure, so as to select, for example, optimum fluid pressure and drilling fluid flow rate.

Figure 1:
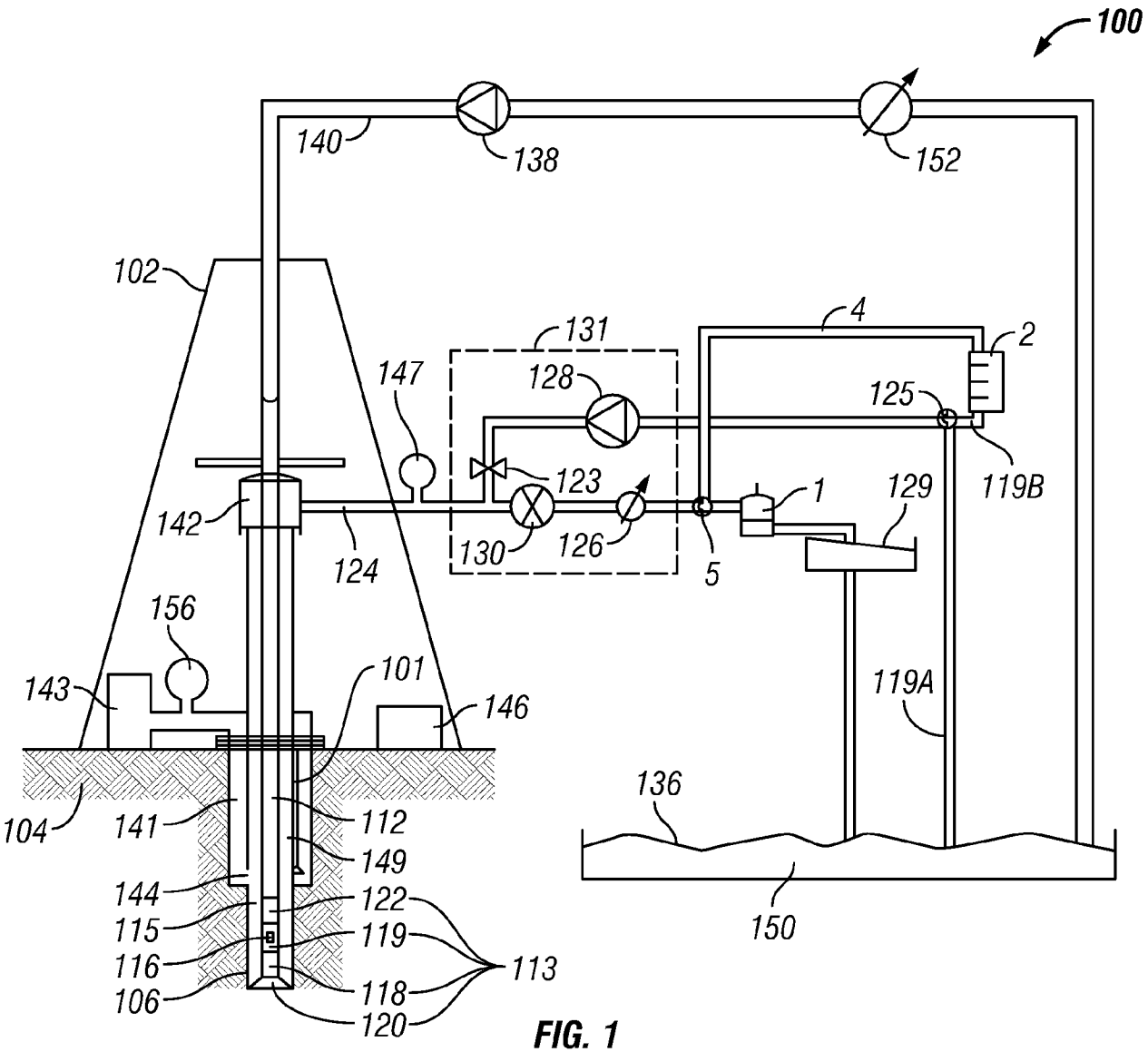
FIG. 1 shows an example of a wellbore drilling unit including a dynamic annular pressure control (DAPC) system.

An example of a drilling unit drilling a wellbore through subsurface rock formations, including a dynamic annular pressure control (DAPC) system is shown schematically in FIG. 1. Operation and details of the DAPC system may be substantially as described in U.S. Pat. No. 7,395,878 issued to Reitsma et al. and assigned to the assignee of the present invention or may be as described in U.S. Pat. No. 6,904,981 issued to van Riet and assigned to the assignee of the present invention.

The drilling system 100 includes a hoisting device known as a drilling rig 102 that is used to support drilling operations through subsurface rock formations such as shown at 104. Many of the components used on the drilling rig 102, such as a Kelly (or top drive), power tongs, slips, draw works and other equipment are not shown for clarity of the illustration. A wellbore 106 is shown being drilled through the rock formations 104. A drill string 112 is suspended from the drilling rig 102 and extends into the wellbore 106, thereby forming an annular space (annulus) 115 between the wellbore wall and the drill string 112, and/or between a casing 101 (when included in the wellbore) and the drill string 112. One of the functions of the drill string 112 is to convey a drilling fluid 150 (shown in a storage tank or pit 136), the use of which is for purposes as explained in the Background section herein, to the bottom of the wellbore 106 and into the wellbore annulus 115.

The drill string 112 supports a bottom hole assembly ("BHA") 113 proximate the lower end thereof that includes a drill bit 120, and may include a mud motor 118, a sensor package 119, a check valve (not shown) to prevent backflow of drilling fluid from the annulus 115 into the drill string 112. The sensor package 119 may be, for example, a measurement while drilling and logging while drilling (MWD/LWD) sensor system. In particular the BHA 113 may include a pressure transducer 116 to measure the pressure of the drilling fluid in the annulus 115 near the bottom of the wellbore 106. The BHA 113 shown in FIG. 1 can also include a telemetry transmitter 122 that can be used to transmit pressure measurements made by the transducer 116, MWD/LWD measurements as well as drilling information to be received at the surface. A data memory including a pressure data memory may be provided at a convenient place in the BHA 113 for temporary storage of measured pressure and other data (e.g., MWD/LWD data) before transmission of the data using the telemetry transmitter 122. The telemetry transmitter 122 may be, for example, a controllable valve that modulates flow of the drilling fluid through the drill string 112 to create pressure variations detectable at the surface. The pressure variations may be coded to represent signals from the MWD/LWD system and the pressure transducer 116.

The drilling fluid 150 may be stored in a reservoir 136, which is shown in the form of a mud tank or pit. The reservoir 136 is in fluid communications with the intake of one or more mud pumps 138 that in operation pump the drilling fluid 150 through a conduit 140. An optional flow meter 152 can be provided in series with one or more mud pumps 138, either upstream or downstream thereof. The conduit 140 is connected to suitable pressure sealed swivels (not shown) coupled to the uppermost segment ("joint") of the drill string 112. During operation, the drilling fluid 150 is lifted from the reservoir 136 by the pumps 138, is pumped through the drill string 112 and the BHA 113 and exits the through nozzles or courses (not shown) in the drill bit 120, where it circulates the cuttings away from the bit 120 and returns them to the surface through the annulus 115. The drilling fluid 150 returns to the surface and goes through a drilling fluid discharge conduit 124 and optionally through various surge tanks and telemetry systems (not shown) to be returned, ultimately, to the reservoir 136.

A pressure isolating seal for the annulus 115 is provided in the form of a rotating control head forming part of a blowout preventer ("BOP") 142. The drill string 112 passes through the BOP 142 and its associated rotating control head. When actuated, the rotating control head on the BOP 142 seals around the drill string 112, isolating the fluid pressure therebelow, but still enables drill string rotation and longitudinal movement. Alternatively a rotating BOP (not shown) may be used for essentially the same purpose. The pressure isolating seal forms a part of a back pressure system used to maintain a selected fluid pressure in the annulus 115.

As the drilling fluid returns to the surface it goes through a side outlet below the pressure isolating seal (rotating control head) to a back pressure system configured to provide an adjustable back pressure on the drilling fluid in the annulus 115. The back pressure system comprises a variable flow restrictive device, suitably in the form of a wear resistant choke 130. It will be appreciated that there exist chokes designed to operate in an environment where the drilling fluid 150 contains substantial drill cuttings and other solids. The choke 130 is one such type and is further capable of operating at variable pressures, flowrates and through multiple duty cycles.

The drilling fluid 150 exits the choke 130 and flows through an optional flow meter 126 to be directed through an optional degasser 1 and solids separation equipment 129. The degasser 1 and solids separation equipment 129 are designed to remove excess gas and other contaminants, including drill cuttings, from the drilling fluid 150. After passing through the solids separation equipment 129, the drilling fluid 150 is returned to reservoir 136.

The flow meter 126 may be a mass-balance type or other high-resolution flow meter. A pressure sensor 147 can be optionally provided in the drilling fluid discharge conduit 124 upstream of the variable flow restrictive device (e.g., the choke 130). A flow meter, similar to flow meter 126, may be placed upstream of the back pressure means 131 in addition to the back pressure sensor 147. Back pressure control means including a pressure monitoring system 146 are provided for monitoring data relevant for the annulus pressure, and providing control signals to at least the back pressure system 131 and optionally also to the injection fluid injection system and/or to the primary pump.

In general terms, the required back pressure to obtain the desired annulus pressure proximate the bottom of the wellbore 106 can be determined by obtaining at selected times information on the existing pressure of the drilling fluid in the annulus 115 in the vicinity of the BHA 113, referred to as the bottom hole pressure (BHP), comparing the information with a desired BHP and using the differential between these for determining a set-point back pressure. The set point back pressure is used for controlling the back pressure system in order to establish a back pressure close to the set-point back pressure. Information concerning the fluid pressure in the annulus 115 proximate the BHA 113 may be determined using an hydraulic model and measurements of drilling fluid pressure as it is pumped into the drill string and the rate at which the drilling fluid is pumped into the drill string (e.g., using a flow meter or a "stroke counter" typically provided with piston type mud pumps). The BHP information thus obtained may be periodically checked and/or calibrated using measurements made by the pressure transducer 116.

The injection fluid pressure in an injection fluid supply 143 passage represents a relatively accurate indicator for the drilling fluid pressure in the drilling fluid gap at the depth where the injection fluid is injected into the drilling fluid gap. Therefore, a pressure signal generated by an injection fluid pressure sensor anywhere in the injection fluid supply passage, e.g., at 156, can be suitably used to provide an input signal for controlling the back pressure system, and for monitoring the drilling fluid pressure in the wellbore annulus 115.

The pressure signal can, if so desired, optionally be compensated for the density of the injection fluid column and/or for the dynamic pressure loss that may be generated in the injection fluid between the injection fluid pressure sensor in the injection fluid supply passage and where the injection into the drilling fluid return passage takes place, for instance, in order to obtain an exact value of the injection pressure in the drilling fluid return passage at the depth where the injection fluid is injected into the drilling fluid gap.

The pressure of the injection fluid in the injection fluid supply passage 141 is advantageously utilized for obtaining information relevant for determining the current bottom hole pressure. As long as the injection fluid is being injected into the drilling fluid return stream, the pressure of the injection fluid at the injection depth can be assumed to be equal to the drilling fluid pressure at the injection point 144. Thus, the pressure as determined by the injection fluid pressure sensor 156 can advantageously be used to generate a pressure signal for use as a feedback signal for controlling or regulating the back pressure system.

It should be noted that the change in hydrostatic contribution to the down hole pressure that would result from a possible variation in the injection fluid injection rate, is in close approximation compensated by the above described controlled re-adjusting of the back pressure means. Thus by controlling the back pressure means in accordance with the invention, the fluid pressure in the bore hole is almost independent of the rate of injection fluid injection.

One possible way to use the pressure signal corresponding to the injection fluid pressure, is to control the back pressure system so as to maintain the injection fluid pressure on a certain suitable constant value throughout the drilling or completion operation. The accuracy is increased when the injection point 144 is in close proximity to the bottom of the bore hole.

When the injection point 144 is not so close to the bottom of the wellbore 106, the magnitude of the pressure differential over the part of the drilling fluid return passage stretching between the injection point 144 and the bottom of the wellbore 106 is preferably to be established. For this, a hydraulic model can be utilized as will be described below.

In one example, the pressure difference of the drilling fluid in the drilling fluid return passage in a lower part of the wellbore 106 extending between the injection fluid injection point and the bottom of the well bore, can be calculated using a hydraulic model taking into account inter alia the well geometry. Because the hydraulic model is generally only used for calculating the pressure differential over a relatively small section of the wellbore 106, the precision is expected to be much better than when the pressure differential over the entire wellbore length must be calculated.

In the present example, the back pressure system 131 can be provided with a back pressure pump 128, in parallel fluid communication with the wellbore annulus 115 and the choke 130, to pressurize the drilling fluid in the drilling fluid discharge conduit 124 upstream of the flow restrictive device 130. The intake of the back pressure pump 128 is connected, via conduit 119, to a drilling fluid supply which may be the reservoir 136. A stop valve 125 may be provided in conduit 119A/B to isolate the back pressure pump 128 from the drilling fluid supply Optionally, a valve 123 may be provided to selectively isolate the back pressure pump 128 from the drilling fluid discharge system.

The back pressure pump 128 can be engaged to ensure that sufficient flow passes the choke 130 to be able to maintain backpressure, even when there is insufficient flow coming from the wellbore annulus 115 to maintain pressure on the choke 130. However, in some drilling operations it may often suffice to increase the weight of the fluid contained in the upper part 149 of the well bore annulus by reducing the injection fluid injection rate when the circulation rate of drilling fluid 150 via the drill string 112 is reduced or interrupted.

The back pressure control system in the present example can generate the control signals for the back pressure system, suitably adjusting not only the variable choke 130 but also the back pressure pump 128 and/or valve 123.

In the present example, the drilling fluid reservoir 136 comprises a trip tank 2 in addition to the mud tank or pit. A trip tank is normally used on a drilling rig to monitor drilling fluid gains and losses during movement of the drill string into and out of the wellbore 106 (known as "tripping operations"). It is noted that the trip tank may not be used extensively when drilling using a multiphase fluid system such as described hereinabove involving injection of a gas into the drilling fluid return stream, because the wellbore 106 may often remain alive or the drilling fluid level in the well drops when the injection gas pressure is bled off. However, in the present embodiment the functionality of the trip tank is maintained, for instance for occasions where a high-density drilling fluid is pumped down instead in high-pressure wells.

A valve manifold can be provided downstream of the back pressure system 131 to enable selection of the reservoir to which drilling mud returning from the wellbore 106 is directed. In the present example, the valve manifold can include a two way valve 5, allowing drilling fluid returning from the well or to be directed to the mud pit 136 or the trip tank 2.

The valve manifold may also include a two way valve 125 provided for either feeding drilling fluid 150 from reservoir 136 via conduit 119A or from reservoir 2 via conduit 119B to a backpressure pump 128 optionally provided in parallel fluid communication with the drilling fluid return passage 115 and the choke 130.

In operation, valve 125 would be operated to select either conduit 119A or conduit 119B, and the backpressure pump 128 engaged to ensure sufficient flow passes the choke system to be able to maintain backpressure, even when there is no flow coming from the annulus 115. Unlike the drilling fluid passage inside the drill string, the injection fluid supply passage can preferably be dedicated to one task, which is supplying the injection fluid for injection into the drilling fluid gap. This way, its hydrostatic and hydrodynamic interaction with the injection fluid can be accurately determined and kept constant during an operation, so that the weight of the injection fluid and dynamic pressure loss in the supply passage can be accurately established.

The description of the drilling system above with reference to FIG. 1 is to provide an example of drilling a wellbore using a DAPC system which can maintain a selected annulus fluid pressure near the bottom of the wellbore 106, i.e., the above-described BHP. Such system may include an hydraulics model that, as explained above, uses as input the rheological properties of the drilling mud 150, the rate at which the mud flows into the wellbore, the wellbore and drill string configuration, pressure on the discharge conduit and if available, measurements of annulus fluid pressure (e.g., from transducer 116) proximate the bottom of the wellbore to supplement or refine calculations made by the hydraulics model.

In methods according to the invention, the DAPC system may be operated in a specific manner to provide a measure of the formation integrity while drilling operations are underway, and may also be operated in a specific manner to provide indications of optimum values of drilling operating parameters. "Drilling operating parameters" as used herein is intended to mean parameters that are within the control of the operator of the drilling rig and may include, for example, the axial force applied to the drill bit 120 (by applying part of the axial loading of the drill string 112 to the bit 120). Drilling operating parameters may also include an amount of torque applied to rotate the drill string 112 at a selected speed. Drilling operating parameters may also include the rate at which drilling fluid 150 is moved into the drill string (measured, e.g., by monitoring the flow meter 152) and the selected BHP.

Figure 2:
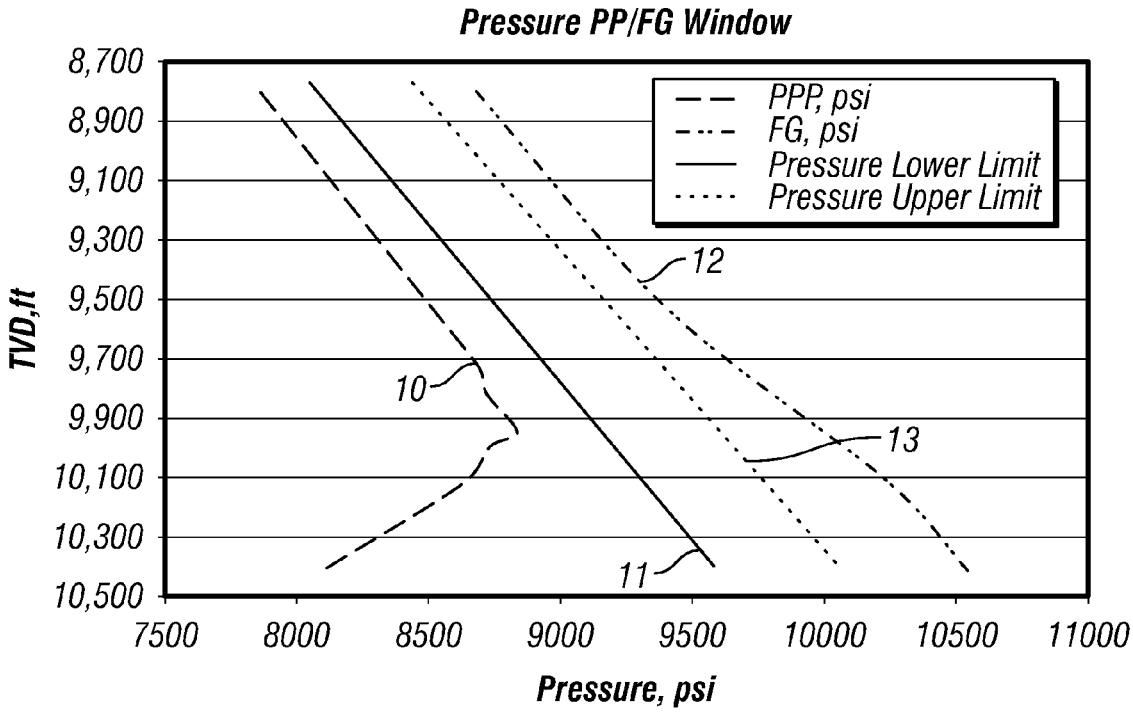
FIG. 2 shows an example of pore pressure and fracture pressure of subsurface rock formations, and bottom hole pressure limits established by an example method.

Referring now to FIG. 2, relationships between formation fluid pressure ("pore pressure") in the pore spaces of the rock formations (e.g., 104 in FIG. 1) and the fluid pressure ("fracture pressure") that if present in the wellbore can cause failure or fracturing of the formations will be explained to illustrate one example method of the invention. As explained above, the drilling fluid (150 in FIG. 1) is moved through the drill string (112 in FIG. 1) to circulate drill cuttings and to provide fluid pressure in the annulus (115 in FIG. 1). Fluid pressure in the annulus (115 in FIG. 1) is needed to prevent fluids in the pore spaces of certain permeable rock formations from entering the wellbore (106 in FIG. 1), and to prevent caving or collapse of the wellbore. Such function is performed by providing the drilling fluid with a selected density, and as is explained in the Reitsma et al. '878 patent, for example, by controlling the pressure in the drilling fluid discharge conduit (e.g., by using the backpressure system) through a combination of choke operation, fluid injection and backpressure application. Conversely, the fluid pressure in the wellbore annulus must not be permitted to exceed the fracture pressure, or the drilling fluid will be lost into the formations subject to fracturing as a result of exceeding the fracture pressure.

It is generally believed that formation fracture pressure of any particular formation in the subsurface is related to the weight of the rock formations above the particular formation in the subsurface (called "overburden"), and to the fluid pressure in the pore spaces of the formation ("pore pressure"). Curve 12 in FIG. 2 shows the expected fracture pressure generally increases with respect to depth in the subsurface. The formation pore pressure is shown by curve 10. Generally, the formation pressure increases with respect to depth, however it is known that certain formations may have lower pore pressures that overlying formations. Such situation is reflected by curve 10 beginning at a depth of about 9,900 feet. The pressure relationships shown in FIG. 2 are common, for example, in subsurface rock formations in the United States Gulf of Mexico where formations having pore pressures above the hydrostatic gradient of brine (called "overpressured" formations) are underlain by formations having pore pressures successively closer to the hydrostatic gradient of brine. The situation shown in FIG. 2 is known as a "pore pressure reversal." What is apparent in FIG. 2 is that the fracture pressure no longer increases linearly with respect to depth. If the BHP (resulting from drilling fluid density and backpressure) is maintained in expectation of higher fracture pressure than is actually present, the formations may fracture. It will be appreciated that the curves shown in FIG. 2 are scaled in units of pressure. The curves shown in FIG. 2 are also known in the art to be scaled in terms of pressure gradient. Pressure gradient is typically expressed in units of equivalent drilling fluid density ("mud weight"); such units known in the art of hydrocarbon wellbore drilling include pounds weight per gallon volume of drilling fluid (ppg).

The curves in the graph of FIG. 2 may be estimated before commencement of drilling the wellbore. Such estimation may be made, for example, by analysis of gravity and seismic surveys to estimate the weight of the rock formations with respect to depth, and velocity analysis of seismic surveys to estimate the fluid pressure. Such techniques are well known in the art. Other information that may be available, such as formation fluid pressure tests and drilling records from nearby wellbores, may be used to refine the estimates made from gravity and seismic surveying. The invention is intended to refine further the estimates of the fracture pressure and pore pressure while drilling operations are underway.

For example, an important element of wellbore construction in situations such as the one shown in FIG. 2 is placement of a pipe or casing (e.g., 101 in FIG. 1) to the correct depth to protect formations subject to fracturing, and as much as possible, to hydraulically isolate formations having lower fluid pressures therein to avoid the drill string becoming stuck in the wellbore by the action of differential pressure. The correct casing depth is related to the pore pressure of the exposed formations and the fracture pressure of the exposed formations, among other factors.

In an example method according to the invention, the DAPC system, e.g., as explained above with reference to FIG. 1, is operated during drilling to increase the bottom hole pressure above the selected set point. Increasing bottom hole pressure may be performed, for example, by any combination of increasing the pumping rate of the mud pump (138 in FIG. 1), increasing the rate of fluid injection from the injection pump (143 in FIG. 1), reducing the orifice of the choke (130 in FIG. 1) and operating the back pressure pump (128 in FIG. 1). The DAPC system may be operated to increase the pressure in selected increments, e.g., 100 pounds per square inch (psi) or other selected increment. As the bottom hole pressure is successively increased, a measurement of drilling fluid volume or mass flow into the wellbore ("flow in"), e.g., using the flow meter (152 in FIG. 1), or using the "stroke counter" where the mud pumps (138 in FIG. 1) are reciprocating piston pumps, is compared with a measurement of the drilling fluid volume or mass flow out ("flow out") of the wellbore, e.g., using the flow meter 126. An indication that less drilling fluid is leaving the wellbore than is being pumped into the wellbore by a selected threshold amount or more may be inferred to be an indication that the bottom hole pressure is at or near the fracture pressure. Such indication may be used to establish a safe upper limit for bottom hole pressure, e.g., along curve 13 in FIG. 2.

The DAPC system may also be operated to selectively reduce the bottom hole pressure. Such reduction may also be made in selected decrements, for example, 100 psi. Measurements of flow out and flow in are made and compared for each decrement. Measurements of flow out that exceed measurements of flow in above a selected threshold amount or more may indicate fluid entry into the wellbore as a result of insufficient bottom hole pressure. Such determinations may be used to establish a safe lower bottom hole pressure limit, e.g., along curve 11 in FIG. 2.

The foregoing procedures may be performed during active drilling of the wellbore (i.e., as the wellbore is lengthened by the action of the drill bit). As will be appreciated by those skilled in the art, as drilling continues, a depth may be approached at which the lowest safe pressure may approach or exceed the highest safe pressure. At such depth it is typically necessary to set a pipe or casing in the wellbore to protect the exposed subsurface rock formations so that drilling can continue safely. By making maximum and minimum safe pressure determinations during drilling of the wellbore as contrasted with relying on pre-drill estimates, it is expected that a maximum possible casing depth may be reached. By determining a maximum possible casing depth using the foregoing technique, it may be possible to avoid two occurrences that have a negative impact on the wellbore. First, setting casing too shallow may be avoided. Setting casing too shallow can have the effect of leaving formations exposed below the depth of the casing that cannot be drilled safely because of formation conditions such as the above described pore pressure reversal, or large increases in pore pressure gradient. In such circumstances it may be necessary to set additional casings coaxially within the existing casing. Such additional coaxial casings can substantially reduce the possible diameter of the wellbore and the ultimate productive capacity of the wellbore. The other occurrence that may be avoided is loss of the wellbore by reason of underground blowout or fracture failure of the formations being drilled. The above described method can assist the wellbore operator in minimizing the possibility of the foregoing two occurrences by determining a best possible casing depth.

Figure 4:
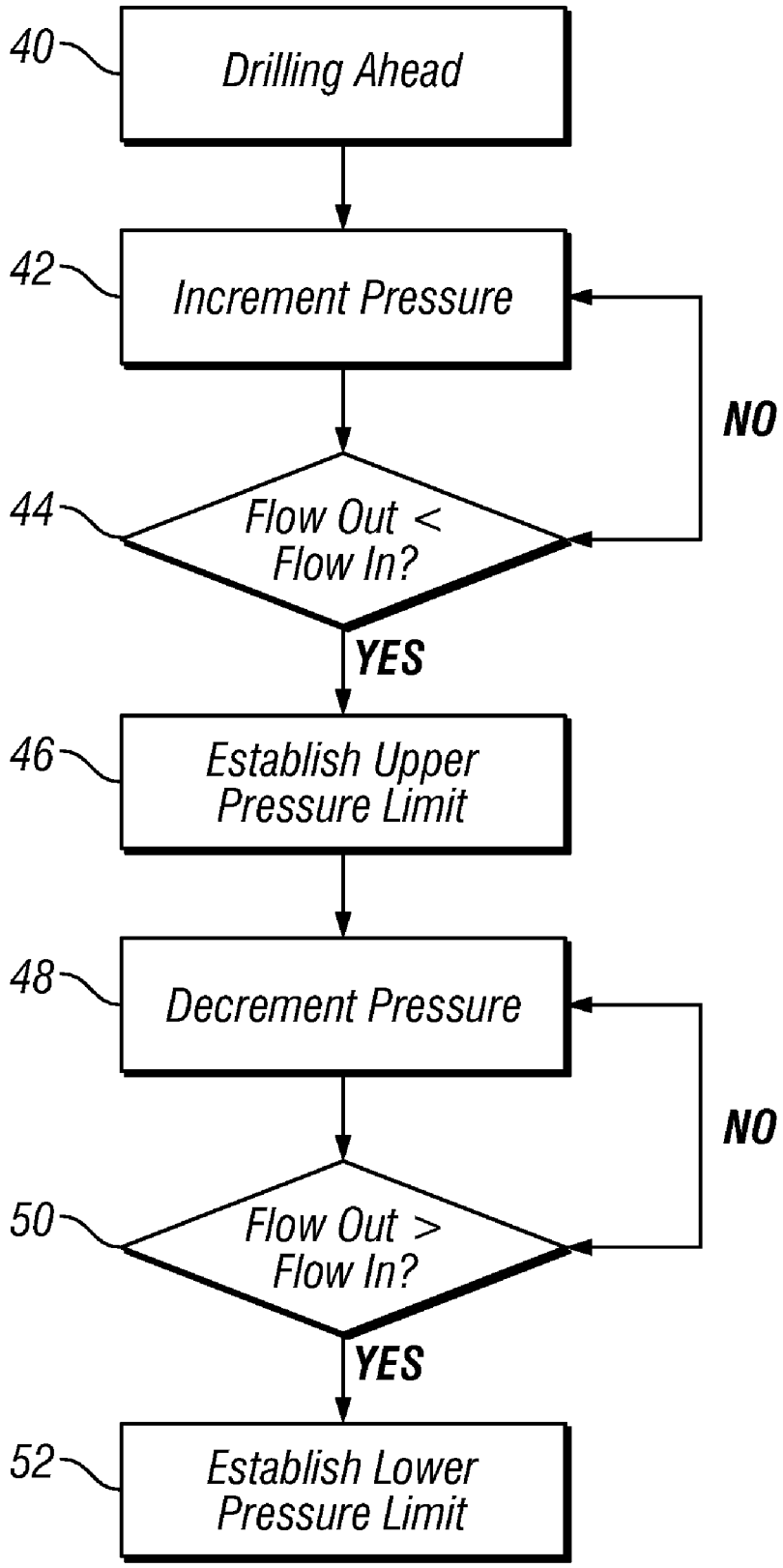
FIG. 4 shows a flow chart of one example method.

Referring to FIG. 4, a flow chart of the foregoing procedure includes the following. At 40, drilling operations are underway and the wellbore is being drilled ahead. At 42, the DAPC system (FIG. 1) may be operated to cause the pressure in the annulus (115 in FIG. 1) to increase by a selected amount. At 44, the flow in is compared to the flow out. If the flow out is substantially the same as the flow out, the DAPC system is operated so that the annulus pressure is again increased. The foregoing is repeated, until at 46 there is indication that the flow out is less than the flow in. The annulus pressure proximate the bottom of the wellbore at that time will be used to establish, also at 46, a safe maximum fluid pressure at the bottom of the wellbore ("bottom hole pressure" or "BHP").

Conversely, and at 48 in FIG. 4, the DAPC system may be operated to reduce the pressure in selected decrements. At 50, measurements of flow in and flow out are compared. Also at 50, if the flow in and flow out are substantially the same, the DAPC system can be operated to decrement the BHP further. The foregoing continues, until at 50 the flow out appears to exceed the flow in. At 52, in such case, the BHP determined at that time may be used to establish a safe lower pressure limit.

Figure 3:
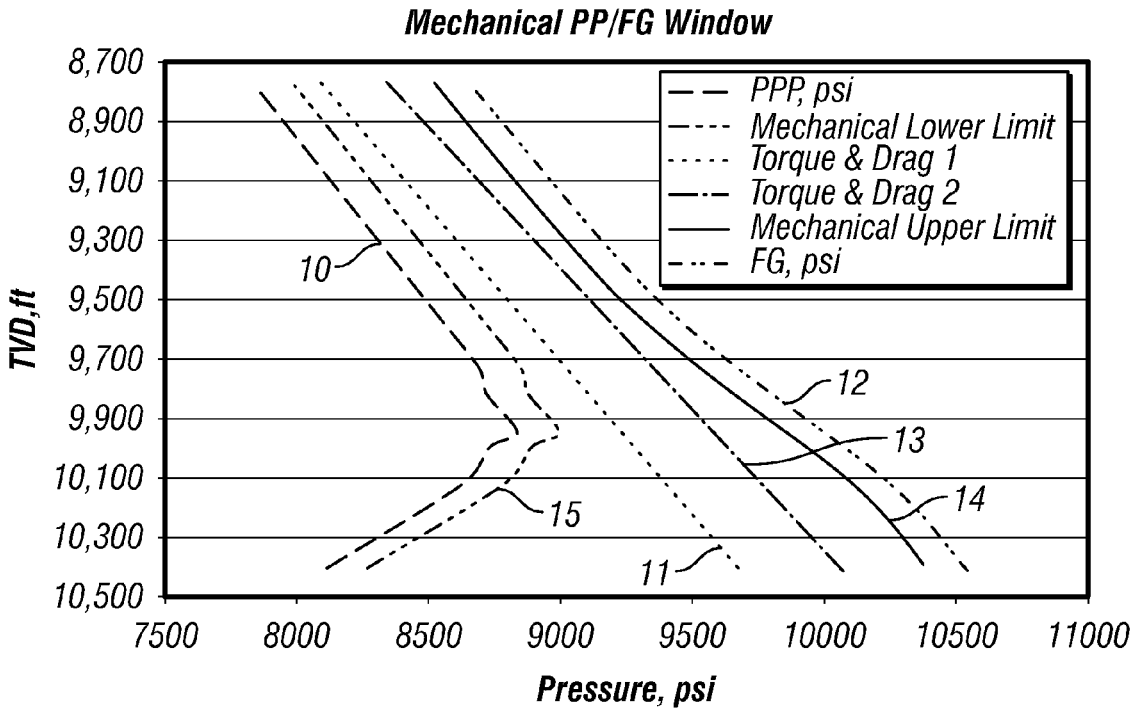
FIG. 3 shows an example of pore pressure and fracture pressure of subsurface rock formations, and bottom hole pressure and mechanical limits established by an example method.
Figure 5:
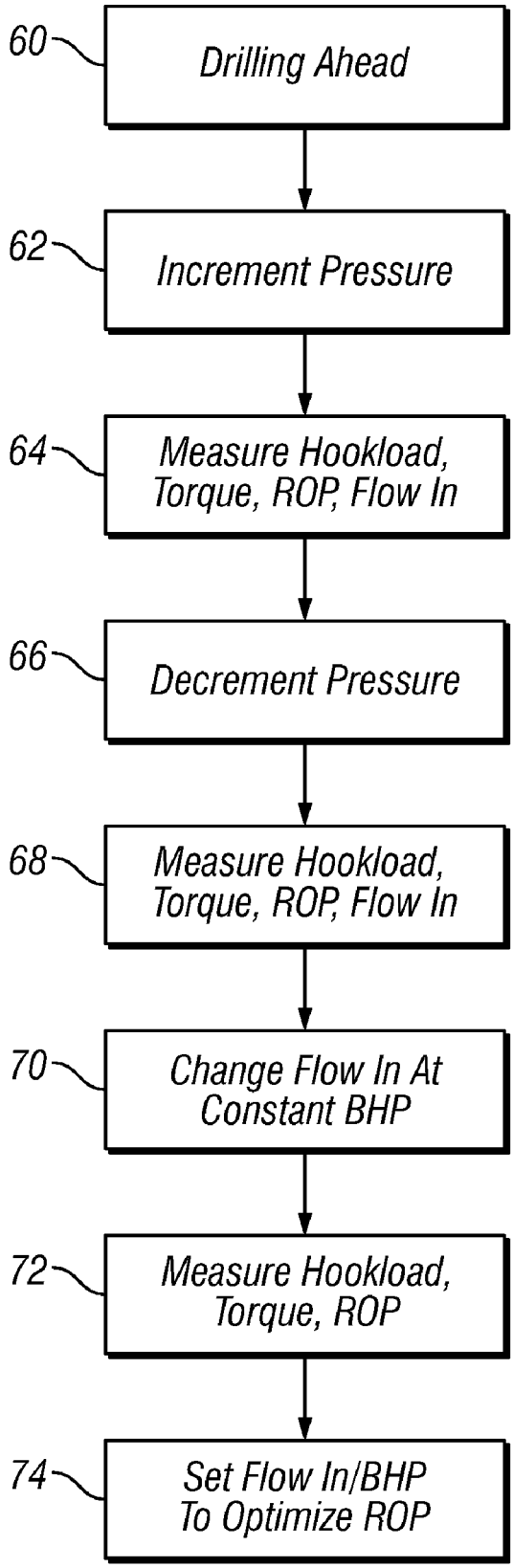
FIG. 5 shows a flow chart of another example method.

Another aspect of the invention will now be explained with reference to FIG. 3. FIG. 3 includes curves pore pressure and fracture pressure curves, 10 and 11, respectively which are substantially the same as those described above with reference to FIG. 2. Pressure limits shown by curves 11 and 13 are also substantially the same as in FIG. 2. Maximum and minimum pressures that can be safely sustained in the wellbore, at curves 14, and 15, will be further explained below. In the present example, optimum values for certain drilling operating parameters (defined above) may be determined during drilling. Referring to the flow chart in FIG. 5, at 60, wellbore drilling operations are underway and drilling continues ahead. At 62, the DAPC system is operated to increment the pressure. At 64, certain drilling operating parameters, such as the "hookload" (the amount of drill string weigh suspended by the drilling rig), the amount of torque applied to the drill string and the flow in rate are measured. A drilling response parameter, such as the rate at which the wellbore is lengthened ("rate of penetration" or "ROP") can also be measured. The foregoing incrementing and measuring in some examples may be repeated until an indication of fracture pressure is obtained (as explained above with reference to FIGS. 2 and 4). At 66, the DAPC system may be operated to decrement the pressure. At 68, drilling operating parameters such as torque, hookload, flow in and response parameters such as ROP may be measured. Such decrementing and measuring in some may be repeated until an indication of pore pressure is obtained (as explained with reference to FIGS. 2 and 4).

At 70, the flow in may be adjusted, e.g., by reducing the rate at which mud is pumped into the drill string. Those skilled in the art will appreciate that the flow in ordinarily should be maintained to at least an amount needed to lift the drill cuttings from the bottom of the wellbore (the "hole cleaning" lower limit). The DAPC system should be operated to maintain the BHP substantially constant while the flow rate is being adjusted. At 72, the hookload, torque and ROP may be measured. The foregoing may be repeated for a range of flow in rates.

The foregoing measurements, made at selected values of BHP and flow in, may be analyzed to provide optimum values of certain drilling operating parameters such as the flow in and the BHP such that drilling response parameters, e.g., ROP are maximized. The foregoing analysis may also provide the minimum value of flow in (and consequent hydraulic horsepower delivered to the drill bit) that is consistent with safe drilling operations. The foregoing measurements, i.e., incrementing and decrementing the BHP, if extended to the pressure limits as explained above, may enable determining the maximum and minimum mechanical pressure limits of the wellbore, e.g., along curves 14 and 15 in FIG. 5. In the most general sense, the various examples of the invention include adjusting the BHP and determining the response of the wellbore to such adjustment. "Response of the wellbore" or "wellbore response" is used as a general term to mean both formation pore pressure and fracture pressure determination and drilling response (e.g., changes in ROP with other drilling operating parameters maintained constant).

Using methods according to the various aspects of the invention may provide better determination of wellbore casing depth and more efficient drilling.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for determining formation integrity during drilling of a wellbore, comprising:

determining an annulus fluid pressure in a wellbore during drilling thereof;

adjusting the annulus pressure by a predetermined amount;

comparing flow rate of drilling fluid into the wellbore to drilling fluid flow rate out of the wellbore;

repeating the adjusting and comparing; and determining at least one of a formation pore pressure and a formation fracture pressure from the annulus pressure when the compared flow rates differ by a selected amount.

2. The method of claim 1 wherein the adjusting comprises incrementing the annulus pressure, and the formation fracture pressure is determined when flow rate into the wellbore exceeds flow rate out of the wellbore.

3. The method of claim 1 wherein the adjusting comprises decrementing the annulus pressure and the formation pore pressure is determined when flow rate out of the wellbore exceeds flow rate into the wellbore.

4. The method of claim 1 further comprising using the determined fracture pressure or pore pressure to estimate a wellbore depth at which a casing is to be set.

5. A method for determining optimum drilling operating parameters during drilling of a wellbore, comprising:

determining an annulus fluid pressure in a wellbore during drilling thereof;

adjusting the annulus pressure by a predetermined amount;

first measuring at least one of a hookload, a drill string torque, a flow rate of drilling fluid into the wellbore and a rate of lengthening of the wellbore;

changing the flow rate by a predetermined amount while maintaining a fluid pressure in a wellbore annulus proximate the bottom of the wellbore substantially constant;

second measuring the at least one of hookload, drill string torque and rate of lengthening; and repeating the adjusting wellbore annulus pressure, first measuring, adjusting the flow rate while maintaining annulus pressure at the bottom of the wellbore and second measuring, and selecting an optimum value of flow rate and wellbore annulus pressure using the repeated second measured hookload, drill string torque and rate of lengthening.

6. A method for determining an optimum fluid pressure in a wellbore annulus during drilling of a wellbore, comprising:

during drilling the wellbore; determining a fluid pressure in the wellbore annulus proximate a bottom of the wellbore;

adjusting the fluid pressure in the annulus by a predetermined amount by operating a back pressure system;

determining a response of the wellbore to the adjusted fluid pressure; and repeating the adjusting fluid pressure and determining wellbore response until an optimum annulus fluid pressure from the wellbore response is determined.

7. The method of claim 6 wherein the wellbore response comprises fluid entry into the wellbore from a subsurface rock formation.

8. The method of claim 6 wherein the wellbore response comprises fluid loss into a subsurface rock formation penetrated by the wellbore.

9. The method of claim 6 wherein the wellbore response comprises a change in torque applied to a drill string used to drill the wellbore.

10. The method of claim 6 wherein the wellbore response comprises a change in rate at which the wellbore is lengthened by drilling.

11. The method of claim 6 wherein the wellbore response comprises a change in suspension load of a drill string used to drill the wellbore.

12. The method of claim 6 further comprising adjusting a flow rate of drilling fluid into the wellbore while maintaining the fluid pressure in the annulus proximate the bottom of the wellbore substantially constant, determining a response of the wellbore to the adjusted flow rate, repeating the adjusting flow rate and determining response of the wellbore until an optimum flow rate from the wellbore response to the adjusted flow rate is determined.

13. The method of claim 12 wherein the wellbore response comprises a change in torque applied to a drill string used to drill the wellbore.

14. The method of claim 12 wherein the wellbore response comprises a change in rate at which the wellbore is lengthened by drilling.

15. The method of claim 12 wherein the wellbore response comprises a change in suspension load of a drill string used to drill the wellbore.

* * * * *